United States Patent [19]

McMillan et al.

[11] Patent Number: 4,470,549

[45] Date of Patent: Sep. 11, 1984

[54] FIRE HOSE NOZZLE

[75] Inventors: Clyde H. McMillan; Robert W. Steingass, both of Valparaiso, Ind.

[73] Assignee: Fire Task Force Innovations, Inc., Valparaiso, Ind.

[21] Appl. No.: 390,749

[22] Filed: Jun. 21, 1982

[51] Int. Cl.[3] ..... B05B 1/30

[52] U.S. Cl. ..... 239/583; 239/526

[58] Field of Search ..... 239/456, 460, 583, 416, 239/417, 526; 251/340, 324, 325, 101, 106, 297

[56] References Cited

U.S. PATENT DOCUMENTS

| | | | |
|---|---|---|---|
| 2,753,219 | 7/1956 | Matarese . | |
| 2,806,741 | 9/1957 | Fishelson | 239/456 |
| 2,955,766 | 10/1960 | Nielsen . | |
| 2,991,016 | 7/1961 | Allenbaugh, Jr. . | |
| 3,210,012 | 10/1965 | Caird . | |
| 3,244,376 | 4/1966 | Thompson | 239/458 |
| 3,533,559 | 10/1970 | Caird | 239/456 |
| 3,537,473 | 11/1970 | DeZurik | 251/101 X |
| 3,863,844 | 2/1975 | McMillan . | |
| 4,252,278 | 2/1981 | McMillan | 239/583 |

*Primary Examiner*—John J. Love
*Assistant Examiner*—James R. Moon, Jr.
*Attorney, Agent, or Firm*—Marshall, O'Toole, Gerstein, Murray & Bicknell

[57] ABSTRACT

A fire hose nozzle assembly employing separable receiver and nozzle sections which are releasably retained in assembled relation by a removable fastener to permit rapid disassembly and reassembly at the scene of a fire in order to remove accumulated debris and other foreign material from the interior of the nozzle assembly so that normal operation can be rapidly and easily restored. The shiftable valve member and valve seat of a flow control and shut-off valve assembly are respectively mounted in the receiver and nozzle sections of the nozzle assembly. Movement of the valve member toward and away from its seat to vary the characteristics of the flow from the nozzle is achieved by a bail-type control handle that is pivotally mounted on the housing of the receiver section. The removable fastener which retains the nozzle section in the receiver section also permits adjustment of the position of the control handle so that engagement of the valve member with its seat is assured when the control handle is shifted fully in a direction to close the valve assembly. An adjustable brake member is mounted in an enlarged head of one of the trunnions which support the control handle and permits adjustment of the force required to move the control handle and to hold the handle in an adjusted position.

16 Claims, 4 Drawing Figures

FIRE HOSE NOZZLE

BACKGROUND OF THE INVENTION

This invention relates to fire hose nozzles, and more particularly relates to a fire hose nozzle assembly provided by two sub-assemblies which may be rapidly and easily disassembled and reassembled in the field for cleaning or other purposes and in which the bail-type handle that is employed to operate the flow control and shut-off valve thereof includes an adjustable brake for varying the force required to manipulate the handle and for holding the latter in different positions of adjustment.

DESCRIPTION OF THE PRIOR ART

Fire hose nozzles have been heretofore developed which utilized a bail-type handle for controlling the position of the flow control valve of the nozzle in order to vary the quantity of water being discharged by the nozzle and to completely shut-off the flow therefrom. An example of such a nozzle is disclosed in the U.S. Fishelson et al Pat. No. 2,806,741. While the advantages of a bail-type handle to control the operating characteristics of a fire hose nozzle are well known, the bail-type handles utilized in many of the nozzles heretofore advanced were incapable of being shifted to and retained in any one of a plurality of infinitely adjusted positions and did not provide a desired feel to the nozzleman. Consequently, it was difficult for the nozzleman to establish and maintain the control valve of the nozzle at a desired flow setting.

Many of the fire hose nozzles heretofore developed were also frequently subject to deteriorating performance in the field due to clogging from rust scale, sand, pebbles, gaskets and small pieces of rubber, metal and wood, which were present in the water supplied to the nozzles. Moreover, because of the construction employed in many of the nozzles, disassembly and cleaning thereof at the scene of a fire was difficult and time consuming.

Accordingly, it is a general object of the present invention to provide a novel and improved fire hose nozzle assembly which overcomes the aforementioned disadvantages and objections of the prior art devices.

Another object is to provide a novel fire hose nozzle assembly which utilizes an adjustable brake construction for resisting movement of the bail-type operating handle of the nozzle in order to assure maintenance of a proper flow setting if the handle is released by the nozzleman and to provide a proper feel to the nozzleman while adjusting the position of the handle.

Still another object is to provide a novel fire hose nozzle assembly which utilizes a separable sub-assembly construction that permits rapid disassembly and reassembly of the nozzle in the field in order to remove accumulated debris and other foreign material from the flow path through the nozzle so as to restore the nozzle to its normal operating condition.

A still further object is to provide a novel mounting for the bail-type control handle of the nozzle assembly which utilizes a drive-shear pin in the connection between the control handle and flow control and shut-off valve to prevent the application of excessive force to the valve components.

These and other objects will become apparent from the detailed description which follows.

BRIEF SUMMARY OF THE INVENTION

Briefly described, the present invention contemplates a novel fire hose nozzle assembly which utilizes a bail-type handle for adjusting the position of the flow control and shut-off valve assembly thereof. To this end, the ends of the arms of the bailtype handle are rotatably supported in bearing bosses on the opposite sides of the nozzle housing by trunnions which extend through the bosses and openings in the ends of the arms. One of the trunnions has an enlarged head at its inner end, which is received in a recess in the outer surface of the housing and which is diametrically bored to receive an adjustable brake member. The brake member frictionally engages the wall of the recess in which the enlarged head is received and retains the handle as well as the movable valve member of the flow control and shut-off valve assembly in an adjusted position and imparts a "feel" to the nozzle assembly.

Torque from the arms of the bail-type handle is transmitted to the shiftable valve member of the valve assembly by a drive-shear pin which extends through the drive arm of the handle and into the enlarged head.

The nozzle assembly utilizes a two-part, separable, subassembly construction which permits rapid disassembly and reassembly of the nozzle assembly in the field. To this end, a manually adjustable fastener is threaded into the tubular housing of the rear or receiver section subassembly for frictionally engaging a tubular body portion of the front or nozzle section subassembly, when the latter is telescoped into the receiver section, so as to releasably retain the subassemblies in assembled relation. When the nozzle and receiver sections are separated, the tubular valve member of the flow control and shut-off valve assembly in the receiver section, and the stationery, conical valve seat element in the nozzle section are exposed and easily accessible for cleaning and/or replacement in the field.

In addition to permitting rapid disassembly and reassembly of the receiver and nozzle sections of the nozzle assembly, the threaded fastener also permits rapid adjustment of the fully closed position of the bail-type control handle by securing the nozzle section subassembly in the receiver section subassembly after the latter has been adjusted so that the valve seat member just contacts the movable valve member of the valve assembly.

DETAILED DESCRIPTION

Figure 1:
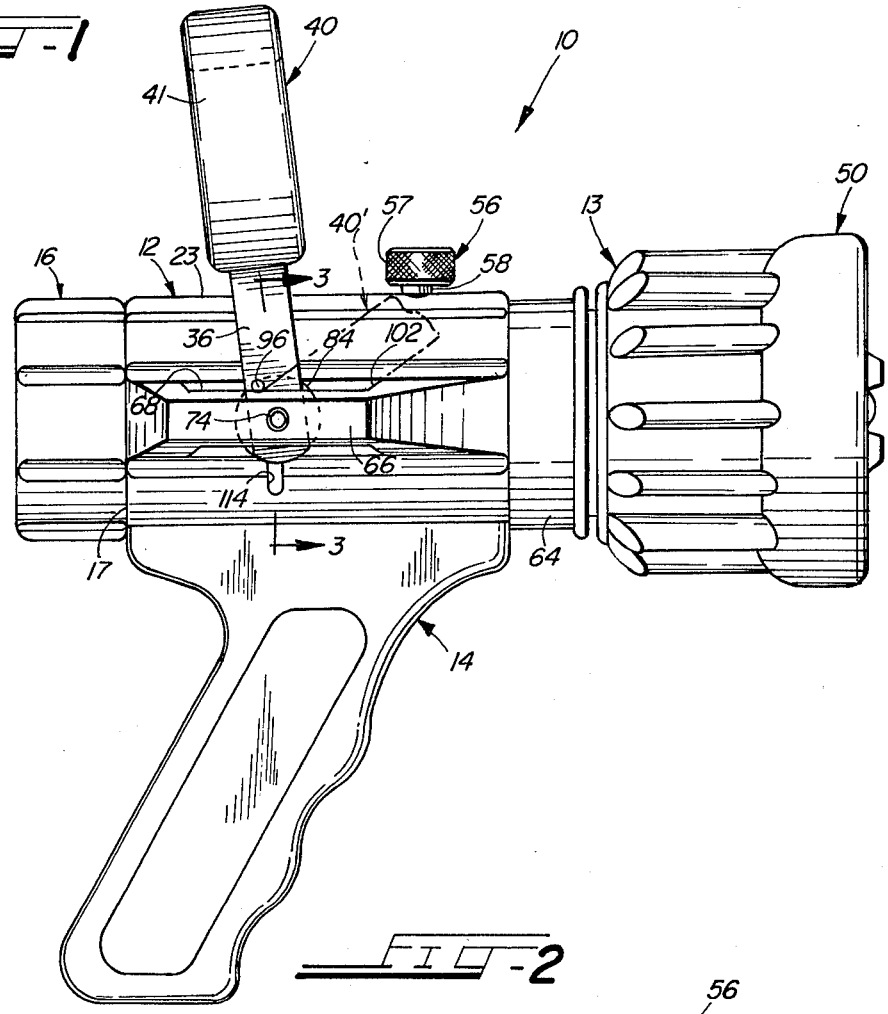
FIG. 1 is a side elevational view of a fire hose nozzle embodying the features of the present invention.

In FIG. 1, a fire hose nozzle assembly embodying the features of the present invention is illustrated and indicated generally at 10. The nozzle assembly 10 comprises a rear or receiver section subassembly 12 and a separable, front or nozzle section subassembly 13. A pistol grip, indicated generally at 14, is shown connected to the receiver section 12 by fasteners (not shown). The pistol grip 14 is an optional component of the nozzle 10. A coupling 16 is connected to the upstream end, indicated at 17, of the receiver section 12 to permit the nozzle assembly 10 to be connected to a hose line carrying fire extinguishing agent under pressure, such as water, or to other firefighting devices or components.

Figure 2:
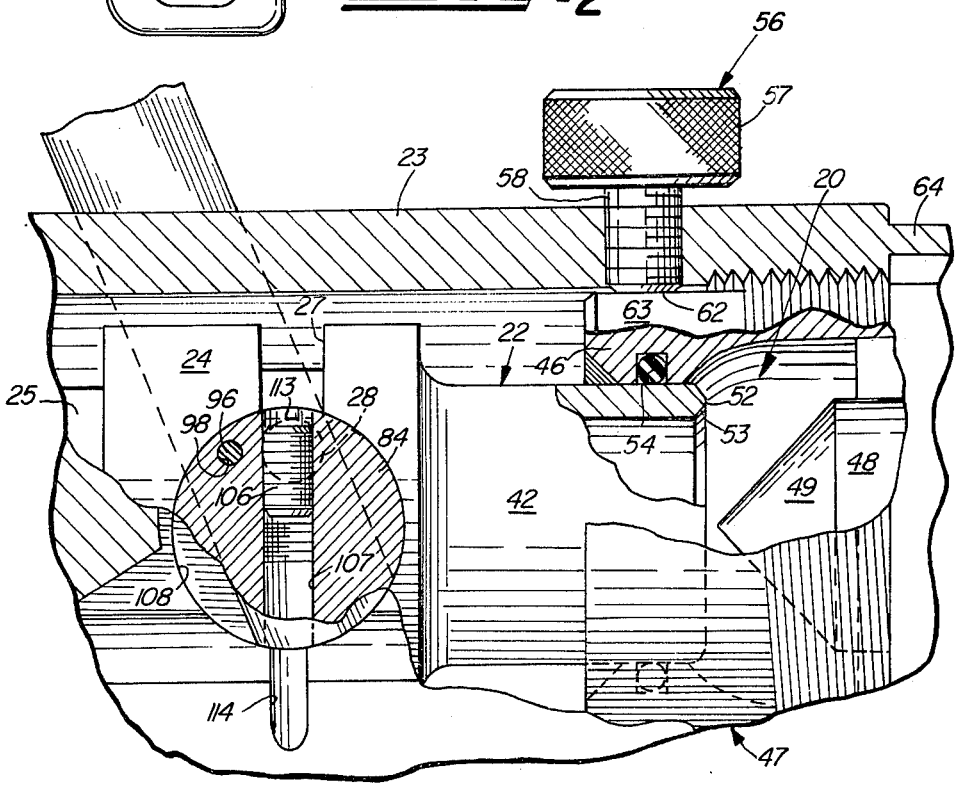
FIG. 2 is an enlarged, fragmentary sectional view, with portions thereof broken away to show underlying details, of the fire hose nozzle illustrated in FIG. 1.
Figure 3:
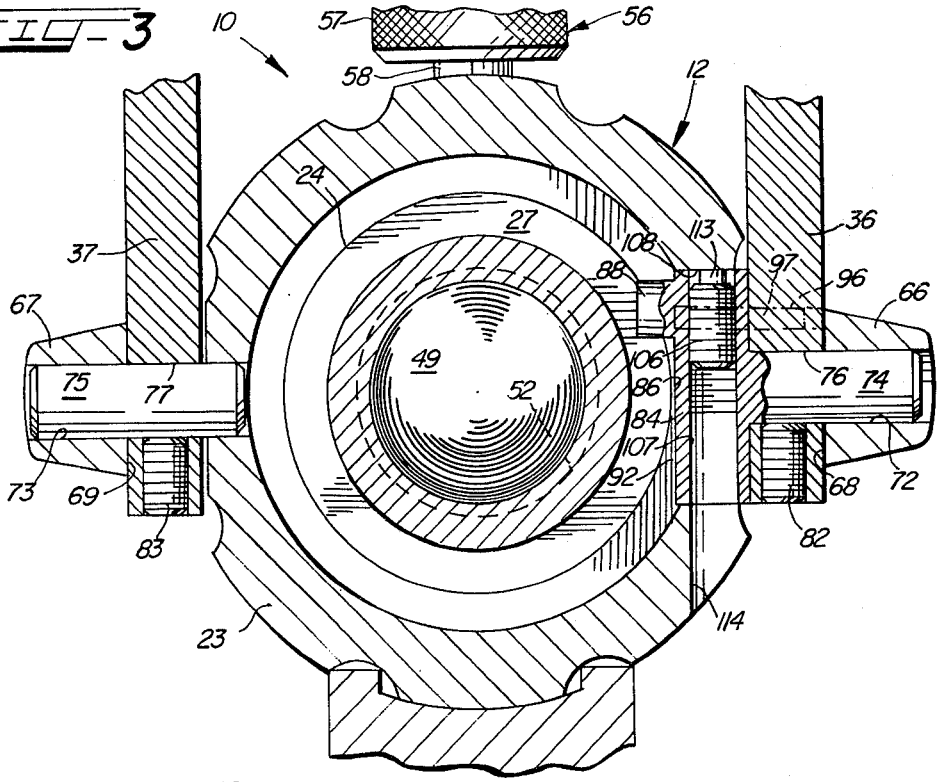
FIG. 3 is a fragmentary sectional view taken substantially along the line 3—3 of FIG. 1.
Figure 4:
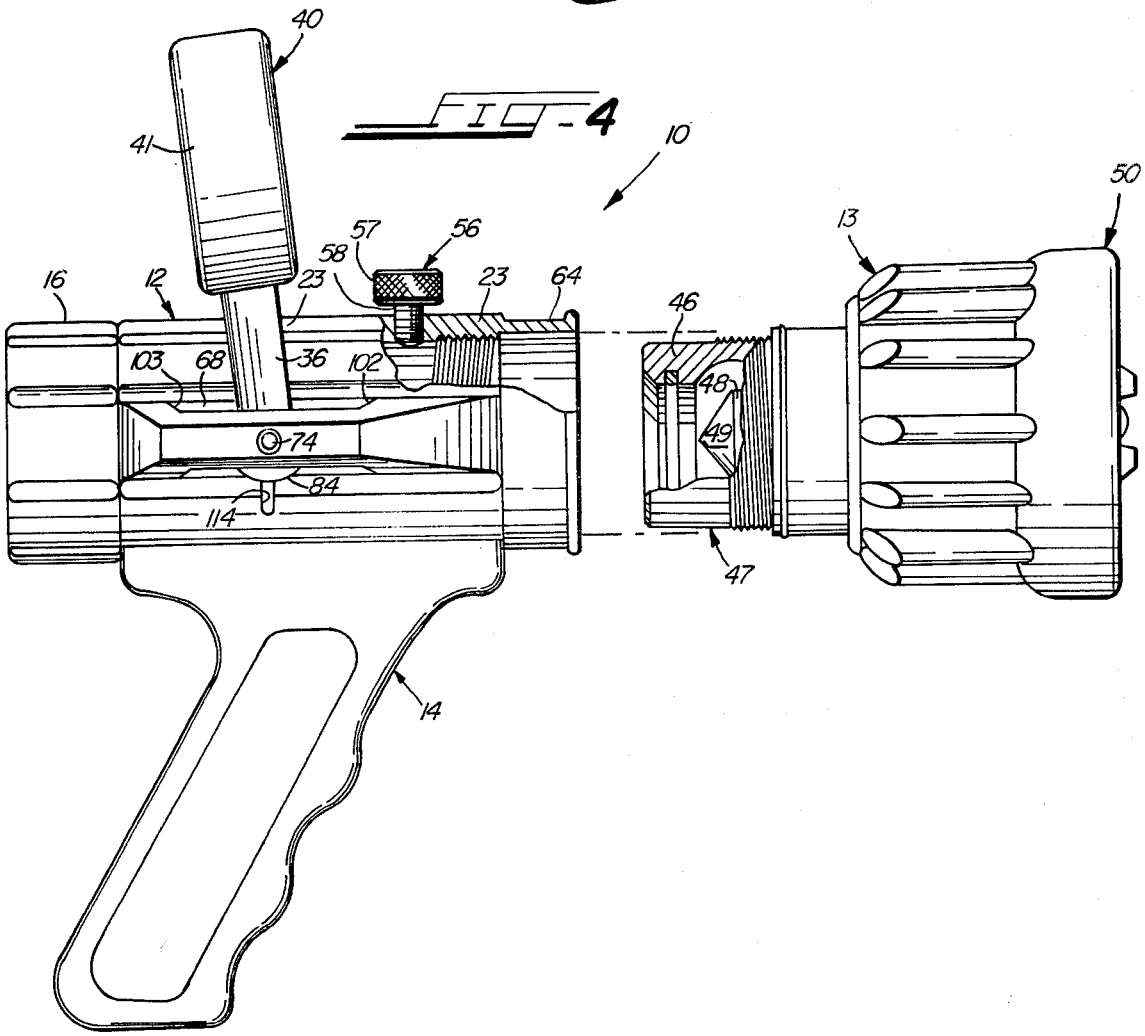
FIG. 4 is an exploded, side elevational view, with portions thereof broken away and others in section to show underlying details, of the fire hose nozzle illustrated in FIG. 1.

Referring now to FIGS. 2, 3 and 4 in conjunction with FIG. 1, it will be seen that the receiver section 12 and nozzle section 13 of the nozzle assembly 10 enclose a flow control and shut-off valve assembly, indicated generally at 20 in FIG. 2, for controlling the flow of fire extinguishing agent through a flow path in the interior of the nozzle assembly 10. The flow control and shut-off valve assembly 20 is substantially the same as that described and claimed in the Clyde H. McMillan U.S. Pat. No. 4,252,278, issued Feb. 24, 1981. Accordingly, reference should be made to this patent for a complete explanation of the construction and mode of operation of the flow control and shut-off valve assembly 20 of the fire hose nozzle assembly 10. The flow control and shut-off valve assembly 20 thus includes a tubular valve member or slider 22, which is mounted in the tubular housing, indicated at 23, of the receiver section 12. The main body, indicated at 24, of the slider 22 is supported by a tubular tail piece portion, part of which is indicated at 25 in FIG. 2. The tail piece 25 extends into the main body 24 of the slider 22 and supports the same for axial movement in the receiver section. A bail-type handle, indicated generally at 40 and having a grip portion 41, effects axial movement of the slider 22 in the housing 23, in a manner to be described more fully hereinafter.

The downstream or flow modulating end portion, indicated at 42, of the slider 22 extends into and is supported by the upstream end, indicated at 46, of a tubular body portion 47 of the front or nozzle section 13. A pressure control cylinder 48 having a conical, upstream end 49 is also supported in the tubular body portion 47 for coaction with the downstream end, indicated at 52, of the flow modulating portion 42 and particularly with a chamfered inner surface 53 of the downstream portion 42, the surface 53 being movable into engagement with the conical end 49 of the cylinder 48 to shut-off all flow through the nozzle assembly 10 and nozzle means in the form of a flow pattern modulating nozzle, indicated generally at 50, at the downstream end of the nozzle section 13. The conical surface 49 thus comprises the valve seat and the flow modulating end portion 42 thus comprises the movable valve member of the valve assembly 20. An O-ring 54 is mounted in an annular recess in the inner peripheral surface of the upstream end 46 of the tubular body portion 47 to provide a moving seal between the downstream end portion 42 of the slider 22 and the upstream end 46 of the tubular body portion 47.

Referring now to FIG. 4 in conjunction with FIG. 2, it will be seen that a removable fastener, such as a thumb screw 56 having a knurled head 57 and a threaded shank 58, is threaded into the housing 23 of the receiver section 12 so that the inner end, indicated at 62, of the shank 58 will engage the outer, cylindrical surface, indicated at 63, of the tubular body portion 47 and hold the latter in an adjusted, operative position in the receiver section 12. Such position is approximately illustrated in FIG. 2.

Thus, the thumb screw 56 serves to hold the nozzle section 13 of the nozzle assembly 10 in a properly adjusted position in the receiver section 12 and also permits rapid disassembly of these components if it should become necessary to do so in the field in order to remove entrapped debris and other foreign material from the flow path through the interior of the nozzle assembly. Such accumulated debris or foreign material adversely affects the flow characteristics of the nozzle. Thus, assuming that it has become evident to a firefighter that debris or other foreign material has accumulated in the flow path and/or on the components of the valve assembly 20 and is adversely affecting the flow from the nozzle 50, he need only unscrew the thumb screw 56 and then unthread the nozzle section 13 from the receiver section 12 to gain access to the interior of the receiver section 12, including the tubular slider 22 and the interior of the tubular body portion 47 of the nozzle section 13. When the receiver and nozzle sections 12 and 13 are separated, the interior of the tubular slider 22 is readily accessible through the downstream end, indicated at 64, of the receiver housing section 23 and the interior of the tubular body 47 is easily accessible through the open upstream end 46 thereof.

After the debris has been removed from the receiver and nozzle sections 12 and 13, these components are easily assembled by threading the body portion 47 of the nozzle section 13 into the downstream end 64 of the receiver section housing 23 until the conical section 49 of the pressure control cylinder 48 engages the chamfered surface 53 of the slider 22 when the latter has been fully shifted to its downstream, flow shut-off position by the handle 40, and then tightening the thumb screw 56 until the inner end 62 thereof engages the outer surface 63 of the body 47. The manner in which this adjustment is performed will be described in greater detail hereinafter.

As heretofore mentioned, the fire hose nozzle assembly 10 includes the bail-type handle 40 for effecting opening and closing of the valve assembly 20 to control the operation of the nozzle. To this end, the ends of the arms 36 and 37 of the handle 40 are pivotally mounted in wings or bosses 66 and 67, respectively, which extend laterally outwardly from the housing 23 and which have longitudinally extending openings or slots 68 and 69, therein for receiving the ends of the arms 36 and 37. The bosses or wings 66 and 67 are transversely bored as at 72 and 73 to receive and journal trunnion pins 74 and 75, which extend through transverse bores 76 and 77, respectively, in the end of the arms 36 and 37. The remote ends of the arms 36 and 37 are bored and threaded to receive set screws 82 and 83 for preventing relative rotation of the trunnion pins 74 and 75 in the bores 76 and 77.

In order to connect the tubular flow control member or slider 22 to the handle 40, the inner end of the trunnion pin 74 has an enlarged, disk-like head 84, which is seated in a circular recess 86 in the outer surface of the housing 23 and sized to receive the disk-like head 84 of the trunnion pin 74 in flush fitting relation. A drive member in the form of a tine or inwardly extending lug 88 is carried on the inner surface, indicated at 92, of the head 84 and is of a length such as to extend into the groove 27 in the main body portion 24 of the slider 22, as illustrated in FIG. 3. The tine or lug 88 is eccentrically positioned on the inner face 92 of the head 84 so that forward and rearward movement of the grip portion 41 of the handle 40 results in a cam action which effects a proportional longitudinal movement of the slider 22.

In order to provide a connection between the slider 22 and handle 40 that will withstand the forces applied to the handle, a drive-shear pin 96 (FIGS. 1, 2 and 3) is provided for this purpose. The drive-shear pin 96 extends through a transverse bore 97 in the arm 36 and an aligned bore 98 (FIG. 2) in the enlarged head 84.

As previously mentioned, the aforementioned thumb screw 56, in addition to facilitating rapid disassembly and reassembly of the receiver and nozzle sections 12 and 13, respectively, for cleaning or other purposes, also serves to assure that the chamfered surface 53 of the slider 22 is engaged with the conical surface 49 of the flow control and shut-off valve assembly 20 when the control handle is in its full forward, valve closing position. To make this adjustment, the following steps should be followed. Initially, the thumb screw 56 is unscrewed sufficiently to permit the nozzle section 13 to be unscrewed sufficiently in the receiver section 12 so that a clearance is established between the conical upstream end 49 of the pressure control cylinder 48 and the chamfered inner surface 53 of the slider 22 when the control handle 40 is in its aforementioned valve closing position. Such position of the handle is determined by engagement of the arms 36 and 37 of the handle with the forward ends of the longitudinal openings or slots 68 and 69 in the bosses 66 and 67. The forward end of the longitudinal opening 68 is indicated at 102 in FIGS. 1 and 4, and the rearward end of the opening 68 is indicated at 103. The forward and rearward ends 102 and 103 thus comprise stops for limiting movement of the handle 40 between positions corresponding to the fully closed and fully open positions of the valve assembly 20.

After the handle 40 is in the aforementioned, valve closing position, which position is fragmentarily illustrated in phantom lines in FIG. 1 and indicated at 40', the nozzle section 13 is screwed back into the receiver section 12 until the chamfered surface 53 of the slider 22 engages the conical surface 49 of the pressure control cylinder 48. This establishes the full closed position of the valve, at which point, the thumb screw 56 is again tightened to lock the nozzle section 13 in the receiver section 12. However, in order to compensate for wear and clearances in the components of the nozzle assembly, the nozzle section 13 can be screwed into the receiver section 12 an additional incremental amount after contact is established between the chamfered section 53 and conical end 49 before the thumb screw 56 is threaded into locking engagement with the body 47 of the nozzle section 13. Positive closing of the valve assembly 20 will thus be obtained when the control handle 40 is shifted fully forwardly toward the ends 102 of the slots 68 and 69.

According to the present invention, it is desirable that the handle 40 remain in a position of adjustment after having been shifted thereto by the nozzleman. To this end, the fire hose nozzle assembly 10 includes adjustable brake means for varying the force required to effect movement of the handle 40 and for retaining the same in an adjusted position with respect to the receiver section 12 when the handle 40 is released. Such brake means in the present instance, comprises a brake member in the form of a set screw 106 (FIGS. 2 and 3) which is threaded into a bore 107 in the disk-like head 84 of the trunnion pin 74 so as to extend perpendicular to the axis of the trunnion pin 74 and to be movable into engagement with the circumferential wall, indicated at 108, of the recess 84. Preferably, the bore 107 extends diametrically through the disk-like head 84. The inner end of the screw 106 may be provided with an insert or button 113 of wear resistant material, such as nylon or the like. The outer end of the set screw 106 is provided with a socket (not shown) for receiving an appropriately sized wrench.

Access to the set screw 106 is facilitated by a groove 114 in the outer surface of the housing 23. Thus, when the handle 40 is shifted to a position intermediate its full open and full closed positions, such that the bore 107 in the enlarged head 84 is aligned with the groove 114, sufficient torque may be applied to the set screw 106 as is necessary to cause the handle 40 to be frictionally retained in an adjusted position after the same is released by the nozzleman. The drag provided by the set screw 106 also provides a desirable feel to the nozzle assembly 10, which facilitates the operation thereof.

With the foregoing construction, it will now be apparent that the subassembly-type construction provided by the separable receiver and nozzle sections 12 and 13, together with the manually releasable thumb screw 56, permits rapid disassembly of the nozzle assembly 10 at the scene of a fire in order to remove debris or other foreign material which may have accumulated in the flow path through the receiver and nozzle sections 12 and 13, and nozzle 50, and which is impairing the flow characteristics and operation of the nozzle assembly 10. The provision of the removable thumb screw 56 also facilitates adjustment of the position of the parts of the flow control and shut-off valve assembly 20 of the nozzle 10 in a rapid and simplified manner so that full closure of the valve assembly 20 is assured when the control handle 40 is shifted fully forwardly toward its valve closing position.

The provision of the set screw 106 in the enlarged head 84 of the handle support structure also permits adjustment of the force required to shift the handle 40 so that the latter, and consequently the slider 22 of the flow control and shut-off valve assembly 20, will remain in an adjusted position when released by the nozzleman.

While one or more embodiments of the invention have been herein illustrated and described, it will be understood that modifications and variations thereof may be developed which do not depart from the spirit of the invention and the scope of the appended claims.

We claim:

1. In a fire hose nozzle assembly including a hollow receiver section and a nozzle section carried by said receiver section, means within said receiver and nozzle sections providing a flow path for fire extinguishing agent therethrough, said nozzle section including nozzle means for varying the characteristics of the flow of fire extinguishing agent therefrom, said receiver section including an axially shiftable valve member for varying the quantity of fire extinguishing agent discharged from said nozzle means and for shutting off said flow; the improvement comprising a flow-control handle having an arm operatively connected to a pin pivotally supported in said receiver section and connected to said shiftable valve member for effecting reciprocable axial movement of the valve member, and adjustable brake means carried by said pin adapted to apply a frictional force on a surface of said receiver section sufficient to offer frictional resistance to reciprocable movement of said handle into any position of adjustment.

2. The fire hose nozzle assembly of claim 1, in which said adjustable brake means comprises a brake member mounted in a bore extending through said pin and adapted to frictionally engage said receiver section housing to provide said frictional resistance.

3. The fire hose nozzle assembly of claim 1, in which said pin has on the inner end thereof an enlarged head provided with a bore therethrough, said enlarged head pivotally mounted in a recess in the outer surface of said receiver section with said brake member mounted in the bore in said pin and said brake member comprising a screw means threaded into said bore with the inner end of said screw means provided with wear resistant frictional material for engaging the wall of said recess; whereby an adjustment of the position of said screw means in said bore is adapted to provide said frictional force.

4. The fire hose nozzle assembly of claim 1, in which said pin has at the inner end thereof an enlarged head pivotally seated in a recess in the receiver section, said head having a lug extending inwardly from the inner lateral surface thereof at a point spaced from the pivotal axis of said head, and said lug adapted to operatively engage said valve member whereby movement of said handle effects longitudinal movement of said valve member.

5. In a fire hose nozzle assembly including a hollow tubular receiver section and a tubular nozzle section carried by said receiver section, means within said receiver and nozzle sections providing a flow path for fire extinguishing agent therethrough, said nozzle section including means for varying the characteristics of the flow of fire extinguishing agent therefrom, shut-off valve means having a shiftable valve member for varying the quantity of fire extinguishing agent discharged from said nozzle means and for shutting off said flow path, a bail-type handle having a pair of laterally spaced arms pivotally mounted in bearing means carried by said receiver section and operatively connected to said shiftable valve member; the improvement comprising adjustable brake means operatively connected to one of the arms of said bail-type handle for varying the force required to effect movement of said handle into any adjusted position with respect to said receiver section, said adjustable brake means comprising a brake member connected to one of said arms and adapted for frictionally engaging said receiver section, said bearing means comprising a pair of laterally outwardly extending bosses on the outer surface of said receiver section housing and a pair of trunnions extending through transverse bores in said bosses and through the ends of the arms of said handle, the inner end of one of said trunnions provided with an enlarged head having a bore therethrough, the outer surface of said receiver section housing having a recess for slidably receiving said enlarged head therein, and said brake member comprising a screw means threaded into a bore in said enlarged head so that one end of said screw means is adapted to frictionally engage the wall of said recess in said receiver section; whereby adjustment of the position of said screw in said bore varies the force required to effect movement of said handle.

6. The fire hose nozzle assembly of claim 5, in which said end of said screw means which frictionally engages the side wall of said recess includes an insert of wear resistant frictional material.

7. The fire hose nozzle assembly of claim 5, in which said enlarged head comprises a circular disk, said recess in the outer surface of said receiver section is circular and has a cylindrical side wall, said enlarged head of said one trunnion is seated in said recess, and said bore in said enlarged head extends perpendicularly to the axis of said one trunnion.

8. The fire hose nozzle assembly of claim 7, in which said bore in said enlarged head extends substantially diametrically therethrough.

9. The fire hose nozzle of claim 7, in which said circular disk has a peripheral side wall, said bore in said enlarged head extends perpendicularly to the axis of said one trunnion and opens in said peripheral side wall, the outer surface of said enlarged head is substantially flush with the outer surface of said receiving section housing, a groove is provided in the outer surface of said receiving section to provide access to said screw means, and said groove is coextensive with said bore in said enlarged head when said handle is in an intermediate adjusted position.

10. A fire hoze nozzle assembly with axial reciprocable flow control means capable of being rapidly and easily disassembled and reassembled to permit removal of debris and other foreign materials from a flow path through the interior thereof, said nozzle assembly comprising a receiver section and a nozzle section, said receiver section having a tubular housing having an upstream end adapted to be connected to a source of fire fighting agent under pressure and a downstream end, said nozzle section having an upstream end with a tubular body portion adapted for sliding telescopic engagement with the downstream end of said receiver section and having flow shaping nozzle means at the downstream end thereof, means for releasably securing said upstream end of said nozzle section to said downstream end of said receiver section, flow control and shut-off valve means disposed within said receiver and nozzle sections and accessible through the open downstream end of said receiver section and the open upstream end of the tubular body portion of said nozzle section, said flow control and shut-off valve means comprising a valve seat mounted in the tubular body portion of said nozzle section disposed toward and adjacent the upstream end of said nozzle section and a tubular valve member axially mounted in the tubular housing adjacent the downstream end of said receiver section and axially movable between an engaged position with said valve seat and a position spaced from said valve seat, said valve seat and tubular valve member being easily accessible for removing said debris and other foreign materials therefrom through the open downstream end of said receiver section and the open upstream end of said nozzle section when said receiver and nozzle sections are separated.

11. The fire hose nozzle assembly of claim 10, wherein said means for releasably securing comprises a fastener member extending through said receiver section adapted to engage the tubular body portion of said nozzle section for releasably retaining said nozzle section carrying said valve seat in an adjusted assembled relationship with said receiver section carrying said valve member.

12. A fire hose nozzle assembly of claim 11, in which said fastener is a removable fastener comprising a thumb screw threaded into the tubular housing of said receiver section.

13. The fire hose nozzle assembly of claim 10, in which said tubular body portion of said nozzle section having said valve seat disposed therein is threaded into the tubular housing of said receiver section for adjustably moving said valve seat relative to said valve member to compensate for wear of said valve means.

14. In a fire hose nozzle assembly having a receiver section and a nozzle section, said receiver section having a tubular housing with an upstream end adapted to be connected to a source of fire fighting agent under pressure and a downstream end adapted to engage said nozzle section with an axially shiftable tubular valve member disposed in said tubular housing, means for releasably securing the downstream end of said tubular housing to said nozzle section, said nozzle section having a valve seat member in a tubular body portion at the upstream end thereof and having flow shaped nozzle means at the downstream end; the improvement comprising a valve control means supported by said receiver section adapted to move said valve member longitudinally into and out of shut-off engagement with said valve seat member and comprising a flow control handle operatively connected to a pin pivotally supported in said receiver section, an enlarged head at the inner end of said pin pivotally seated in a recess in the said receiver section, said head having a lug extending inwardly from the inner lateral surface thereof at a point spaced from the pivotal axis of said head, and said lug adapted to operatively engage said valve member whereby movement of said handle effects longitudinal movement of said valve member.

15. A fire hose nozzle assembly as in claim 14, in which said enlarged head of the pin is a circular disc seated in a circular recess in said receiver section with said lug extending inwardly from a point adjacent the circumference of said disc, and said lug engaging a groove in the surface of said valve member.

16. A fire hose nozzle assembly as in claim 14, in which said receiver section is provided with at least one laterally outwardly extending boss having an elongated longitudinally extending opening therein, said handle having an arm with the lower end thereof extending into said opening, said pin extending through a transverse bore in said boss and through said lower end of said arm, and the forward and rearward ends of said opening in said boss providing mechanical stops for limiting the reciprocable movement of said handle between positions of fully closed and fully open position of adjustment of said valve member.

* * * * *